US006705130B2

(12) United States Patent
Weihing et al.

(10) Patent No.: US 6,705,130 B2
(45) Date of Patent: Mar. 16, 2004

(54) KNITTING SYSTEM COMPONENT

(75) Inventors: Frank Weihing, Gomaringen (DE); Oskar Schaffer, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 218 days.

(21) Appl. No.: 10/095,714

(22) Filed: Mar. 13, 2002

(65) Prior Publication Data

US 2002/0129625 A1 Sep. 19, 2002

(30) Foreign Application Priority Data

Mar. 13, 2001 (DE) ..... 101 11 930

(51) Int. Cl.[7] ..... D04B 35/02
(52) U.S. Cl. ..... 66/123
(58) Field of Search ..... 66/123, 116, 122, 66/124, 57, 8, 64, 7, 119

(56) References Cited

U.S. PATENT DOCUMENTS

| | | | | |
|---|---|---|---|---|
| 2,025,462 A | * | 12/1935 | Lombardi | 66/106 |
| 4,434,628 A | | 3/1984 | Tsuzuki | |
| 4,827,740 A | * | 5/1989 | Cottenceau et al. | 66/219 |
| 5,941,099 A | * | 8/1999 | Kawase | 66/116 |
| 6,178,786 B1 | * | 1/2001 | Willmer | 66/221 |

FOREIGN PATENT DOCUMENTS

| | | |
|---|---|---|
| DE | 2 010 973 A | 1/1972 |
| DE | OS1635905 | 7/1985 |
| DE | 3812240 C2 | 5/1990 |
| DE | 3915684 C1 | 5/1990 |
| DE | 43 31 940 C1 | 12/1994 |
| DE | 198 22 862 A1 | 11/1999 |
| EP | 0 908 548 A1 | 4/1999 |

* cited by examiner

*Primary Examiner*—Danny Worrell
(74) *Attorney, Agent, or Firm*—Venable; Norman N. Kunitz

(57) ABSTRACT

To improve the handling of a needle (1) having a selector element (16) that is seated to pivot on the needle body (2), a fastening element (32) is additionally provided. This element secures the selector element (16) to the needle body (2) in a form fit. One or more individual securing elements (34, 35, 36) acting in the transverse direction (33) serves or serve as the fastening element (32). The individual securing elements (34, 35, 36) can act in one direction or in both transverse directions. They are embodied to prevent the selector element (16) from falling out of the needle body (2) in both lateral directions. For this purpose, at least one individual securing element 34, 35, 36 that acts in the transverse directions **33*a*, 33*b* is provided. It is possible to combine all of the individual securing elements 34, 35, 36**.

20 Claims, 7 Drawing Sheets

1
2
3
4
5
6
7
8
11
12
14
16
17
18
19
20
21
22
23
24
33

KNITTING SYSTEM COMPONENT

CROSS REFERENCE TO RELATED APPLICATION

This application claims the priority of German Patent Application No. 101 11 930.5 filed Mar. 12, 2001, which is incorporated herein by reference.

BACKGROUND OF THE INVENTION

The invention relates to a system component, particularly for knitting machines or similar textile machines.

The term system component encompasses all parts of a knitting system, particularly parts of a knitting system of a knitting machine that are seated to move. This term especially refers to components that move in translatory fashion and are directly involved in knitting, or any other loop forming process as well as parts that produce a desired structure, such as cutting needles and the like. The invention can notably be used with knitting-machine needles. Aside from needles, system components include selector parts, coupling elements, sinkers, springs, etc.

For knitting machines, known system components such as needles or other knitting tools are seated to be longitudinally displaced in the needle groove of a needle cylinder or a circular-knitting dial. A so-called drive ring having a cam serves to drive the system components. For purposefully actuating system components such as needles, the components are often provided with or coupled to so-called selector parts, elements, or devices which have a butt that can engage and disengage from the cam. The selector part transmits its longitudinal movement onto the needle or knitting tool.

In the servicing of knitting machines or other stitching machines, the knitting tools, which are present in large numbers, frequently must be removed from their guide channels and reinserted, or replaced with new system components or other knitting tools. If a selector element that is separate from the system component or the needle is associated with the component or needle, and there is no fixed connection between the base body of the system component and the selector element, the task of inserting the system component, with the selector element, into the needle groove requires tremendous dexterity.

SUMMARY OF THE INVENTION

It is an object of the invention to improve the handling of such system components.

This object generally is achieved with a system component according to the invention, having a selector element that is connected to the base body of the system component for permitting the back-and-forth movement of the system component. The selector element is also seated to move such that it engages and disengages from a drive device. A fastening element or securing means, secures the selector element to the base body so as to protect it against a lateral misalignment in at least one transverse direction. Thus, the system component and the selector element form a unit that can manageably be inserted into the needle groove or another guide conduit and removed from it. This ensures that the base body and the selector element do not come apart during assembly, i.e., the insertion of the system component into the needle groove or other conduit.

The selector device or part is, for example, a separate selector element that is seated on the base body so as to pivot about a pivot axis. The pivot axis extends perpendicular to the flat sides of the base body (needle body), and is therefore oriented transversely to the direction of needle movement. If the system component is a needle, the selector element is disposed, for example, on the side facing away from the needle back, and is seated to pivot toward and away from the needle back. The selector element can be seated with a suitable hinge element, whose bearing surfaces virtually occupy the entire width of the needle body, measured from flat side to flat side of the needle body. This ensures a precise, durable seating of the selector element on the needle body.

The selector element is preferably resiliently prestressed in a pivot direction. A spring element, for example in the form of a leaf spring inserted into the base body or the selector element, can serve this purpose. It is also preferable to produce the leaf spring and the selector element, or the base body, in an integral manner, i.e., in one piece. The entire length of a spring element of this type preferably has essentially the same thickness as the rest of the base body and the rest of the selector element (measured from flat side to flat side).

Also conceivable are embodiments in which the spring element is tapered from its point of connection to the needle body or the selector element toward its end.

The spring element can serve in resiliently prestressing the selector element against a stop. This arrangement simultaneously effects the prestressing of the securing element.

The selector element can be embodied as an elongated selector element that is seated to move in a recess of the base body. Its thickness preferably matches the thickness of the base body (needle body). In the assembled state, the flanks of the needle or guide groove guide the selector element, so it is impossible to separate the selector element and the base body without affecting the fastening element as well. When the needle (system component) is being handled outside of the needle groove (guide conduit), however, the fastening element holds the needle body (base body) and selector device together.

The securing element or means is preferably embodied in the form of the pairing of a protrusion and a recess, which are engaged in the inoperative position of the selector element. The inoperative position is the position assumed by the selector element when it is not subjected to any external forces. For example, the spring element prestresses the selector element against stops or protrusions. At least in this state, the at least one protrusion and aforementioned at least one recess effect a form-fitting connection between the selector element and the base body (needle body) for preventing the selector element from slipping laterally off of the needle body.

In a preferred embodiment, the spring element effects a lateral guidance. One end of the spring element is connected to either the selector element or the base body (needle body). Its other end rests resiliently against the selector element or the base body (needle body). In the region of the resilient contact, a form fit can be effected by a groove-like recess in the surface opposite the end of the spring. The end of the spring is tapered, so it extends into this groove in the countersurface and provides lateral guidance due to the prestressing and the contact of the spring with the side walls of the groove. In another possible embodiment, the end of the spring would not be tapered, but the spring would have a protrusion that would extend into this groove A converse embodiment is also possible: A groove would be embodied in the spring, while the countersurface would have a protrusion that would extend into this groove.

It is also advantageous for the ends of the elongated selector element to rest, at least on one side, against the base body (needle body) relative to the transverse direction defined by the hinge axis.

Advantageous details of embodiments of the invention ensue from the drawing, the description and the dependent claims. The drawing illustrates exemplary embodiments of the invention. Shown are in:

BRIEF DESCRIRIPTION OF TIE DRAWINGS

DESCRIPTION OF THE PREFERRED EMBODIEMENTS

Figures 1, 2:
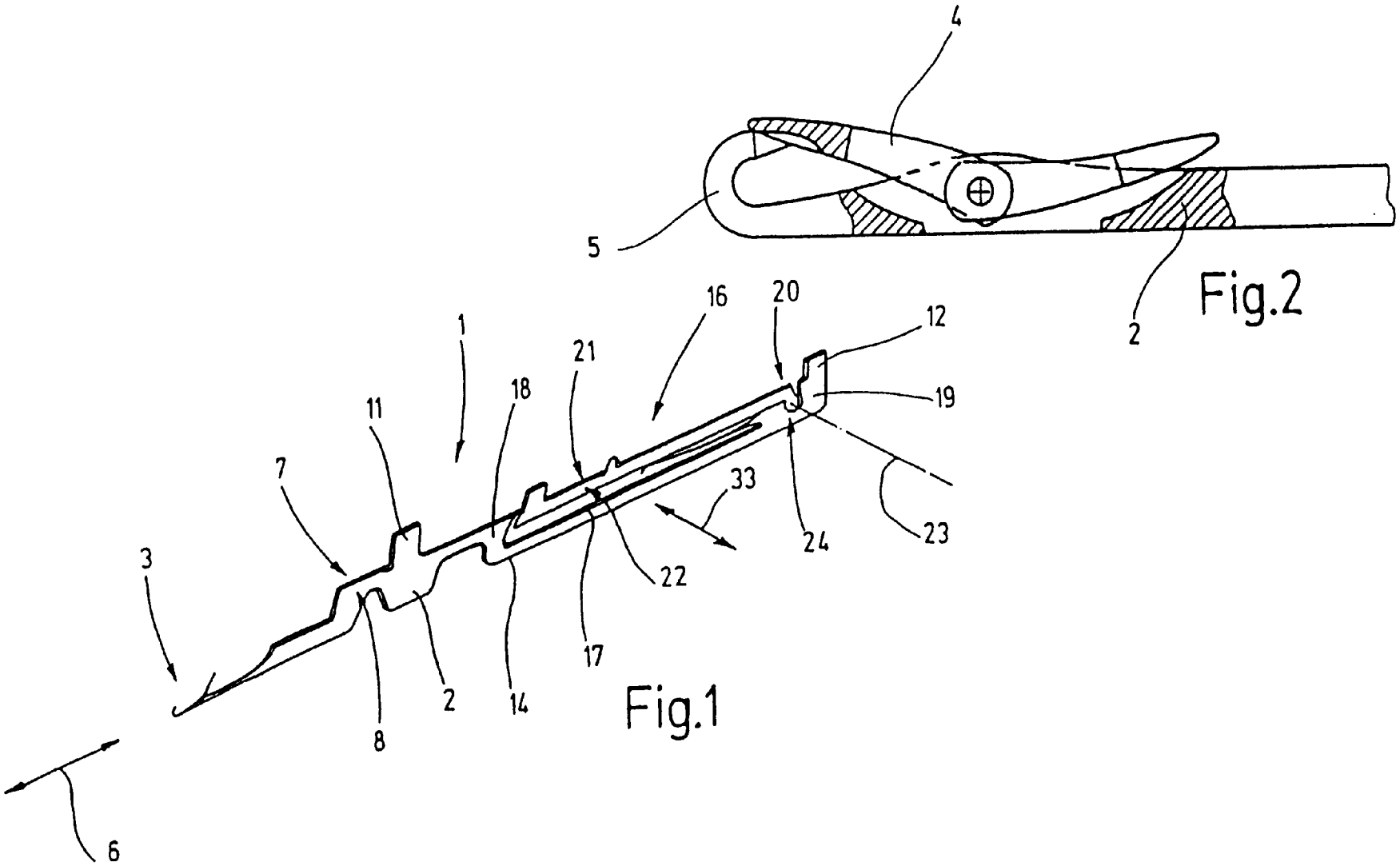
FIG. 1 is a perspective representation of a needle in accordance with the invention.
FIG. 2 is a sectional representation of the head of the needle according to FIG. 1.

A system component is described below by way of the example of a needle 1, such as is used in a knitting machine. FIG. 1 depicts the needle 1, also called the selector needle. The needle 1 has a needle body 2 as the base body, which body supports a head 3 at one end. The head is shown separately in FIG. 2. It has a latch 4 that is seated to pivot, and opens and closes the hook 5 at the end.

The needle 1 is seated to move back and forth in a direction of movement that is symbolized by an arrow 6 in FIG. 1. To this end, the needle 1 is accommodated in a needle (guide) groove (not shown), in which it is guided by its two oppositely-located substantially parallel flat sides 7, 8.

For driving purposes, the needle 1 has one or more butts 11, 12, which extend away from the needle body, starting from the side or edge opposite the needle back 14.

Figures 3, 4, 5, 6, 7:
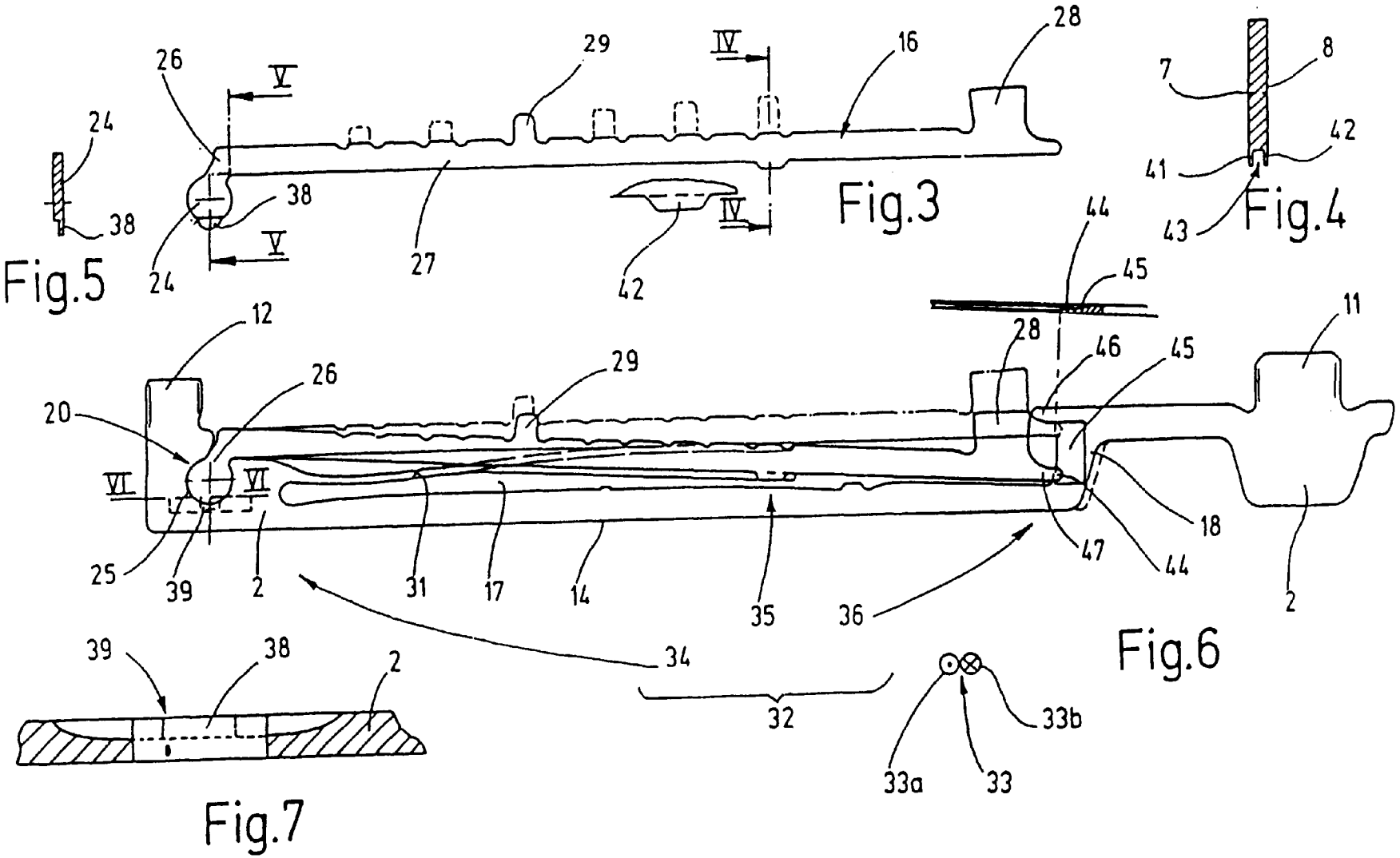
FIG. 3 is a schematic side view of a selector element of the needle according to FIG. 1, on a different scale.
FIG. 4 shows the selector element according to FIG. 3, cut along the sectional line IV—IV and on a different scale.
FIG. 5 shows the selector element according to FIG. 3, cut along the sectional line V—V.
FIG. 6 shows the needle according to FIG. 1, in an enlarged, side view.
FIG. 7 shows the needle according to FIG. 6, cut along the sectional line VI—VI.
Figure 9:
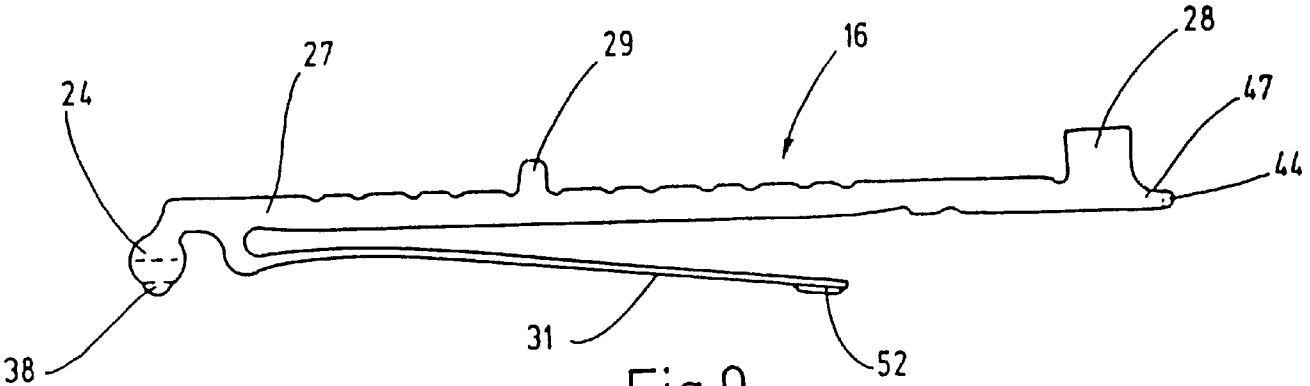
FIG. 9 shows the movable selector element of the needle according to FIG. 8.
Figure 10:
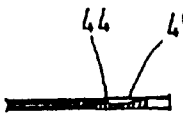
FIG. 10 is a cutout view of the needle according to FIG. 8, in a schematic, plan view.

For targeted driving, the needle 1 also has a selector element 16 as a selector device. This element 16 serves in switching the needle 1 actively or passively for a certain movement, that is, selecting or not selecting the needle. The selector element 16 is received by or mounted in a recess 17 of the needle body, which recess is open toward the side extending away from the needle back 14 and is limited at the front and back, with regard to the direction of movement of the needle 1, by a respective stem 18, 19. The selector element 16 is formed by an elongated, rod-like segment whose lateral flanks 21, 22 end flush with the flat sides 7, 8 of the base body 2. The selector element 16 thus has the same thickness as the needle or base body 2. At the end remote from the head 3, the selector element 16 is seated on the needle body 2 so as to pivot about a pivot axis 23, This axis is defined by a hinge 20, as is particularly apparent in FIG. 6. The selector element 16 shown separately in FIG. 3 has a disk-shaped head 24 at its end adjacent to the stem 19. The head 24 is held in a circular bearing opening 25 that passes transversely through the needle body 2. The bearing opening 25 is open toward the flat sides 7, 8. It is also open at an edge, with its open edge being occupied by a connecting stem 26 (FIGS. 3 and 6). The connecting stem connects the head 24 to a longitudinal stem 27 of the selector element 16.

The side or edge of the longitudinal stern 27 that is remote from the needle back 14 is provided with a selector butt 29, which projects at a right angle away from the longitudinal stem 27 and serves in pivoting the selector element 16. The longitudinal stem 27 also supports at least one further butt 28, which projects away from the longitudinal stem 27 at a right angle, like a flag, and is rendered active or passive through the pivoting of the selector element 16, that is, it can serve in the targeted driving process.

As ensues from FIG. 6, a leaf-spring element 31 is provided in the recess 17. At one end, this spring element 31 is integrally connected, i.e., in one piece, to the needle body 2. The leaf-spring element 31 extends away from the portion of the needle body 2 that is embodied as the hinge 20, in the direction of the stem 18. The leaf-spring element 31 is prestressed such that it prestresses the selector element 16 for pivotable movement about the pivot axis 23, i.e., counterclockwise in FIG. 6.

The needle 1 is provided with a fastening element 32 for securing the selector element 16 in the recess 17 in situations in which the needle 1 is not accommodated in a needle or guide groove. The fastening element 32 may include a plurality of individual securing elements 34, 35, 36, which fix the selector element 16, for example in a form-fit, relative to the transverse direction 33.

The individual securing element 34 is formed by, for example, a protrusion 38 that extends away radially from the head 24, as can be seen in FIGS. 3 and 5. The protrusion 36 can be embodied as a catch approximately half as thick as the rest of the head 24. The catch 38 can be disposed in the center or, as shown in FIG. 5, off-center. Accordingly, this catch 38 has an associated recess 35, which directly adjoins the bearing opening in the needle body 2. The recess 39 is limited in the transverse direction 33 by a side wall that is embodied at the needle body 2 and prevents the catch 38, and therefore the head 24, from moving out of the bearing opening 25. FIG. 7 depicts the form-fitting contact of the catch 38 with the laterally-limiting recess 39, otherwise, the head 24 rests with at least its outside, cylindrical circumferential surface against the cylindrical wall of the bearing opening 25.

The individual securing element 35 is visible in FIGS. 3, 4 and 6. On it side facing the needle body 2, the longitudinal stem 27 has two narrow, wall-like, parallel extensions 41, 42, which define a slot-like space 43 between themselves and, on the outside, end flush with the flat sides 7, 8 of the selector element 16. In the corresponding region, the width of the leaf-spring element 31 corresponds to the spacing between the extensions 41, 42, or is slightly smaller. In other words, this region of the leaf spring 31 is narrower than the rest of the spring. Thus, the leaf-spring element 31 can extend into the intermediate space 43, as shown in FIG. 6. With respect to the transverse direction 33, therefore, a form-fitting connection is produced between the leaf-spring element 31 and the selector element 16.

The individual securing element 36 is disposed at the end of the selector element 16 remote from the hinge 20. The individual securing element 36 includes an extension 44, which extends away from the longitudinal stem 27 in the longitudinal direction. The width of the extension 44 is distinctly smaller than the remaining width of the longitudinal stem 27. The extension engages a recess 45 (FIG. 6) extending over the height of the stem 18. At the end of the stem 18 remote from the needle back 14, the stem 18 is provided with a catch 46 that overlaps the recess 17 in order to form a stop element for the selector element 16. The catch 46 also limits the recess 45.

As can be seen in FIG. 6, the individual securing element 34 prevents the head 24 from moving in a first transverse direction 33*a* (out of the drawing plane), while the individual securing element 36 prevents a movement in a second transverse direction 33*b* (into the drawing plane). The individual securing element 35 blocks in both transverse directions. The selector element 16 is therefore seated on the needle body 2 such that it cannot be lost and can be safely handled.

The needle 1 described to this point functions as follows:

The selector element 16 serves in controlling the movement of the needle 1. As ensues from FIG. 6, the selector element is seated on the needle body 2 to be pivoted by the hinge 20. The leaf-spring element 31 presses the selector element 16 upward in FIG. 6, that is, away from the needle back 14, thereby bringing a finger 47, which extends beneath the catch 46 and is embodied on the selector element 16, into contact with the catch 46. The extension 44 rests loosely against a lateral surface of the stem 13 that is lower due to the recess 45. This serves in laterally securing the front end of the selector element 16 in the direction 33*b*. The protrusion 38 resting against the side wall of the recess 39 secures the rear end of the selector element in the opposite transverse direction 33*a* in the hearing opening 25. In this state, the needle 1 can be safely handled without the risk of the selector element 16 jumping out of the recess 17. The selector element can be inserted into or removed from needle grooves.

In operation, the selector element 16 can be pivoted from the position shown in broken lines in FIG. 6 into the position shown in solid lines. This is effected counter to the prestressing force of the leaf-spring element 31 until the front end of the selector element 16 comes into contact with the needle body 2. The hinge 20 permits a corresponding pivoting movement. This displaces the butts 28, 29 for shifting the needle 1 into different operating modes.

FIGS. 8 through 11 illustrate a modified embodiment of the needle 1. This embodiment differs from the above-described ones solely because the leaf-spring element 31 is embodied or disposed on the selector element 16. Preferably, as shown, one of the ends of the leaf-spring spring element is connected in one piece to or integral with the longitudinal stem 27. The connection is preferably produced near the head 24 as shown.

Figure 11:
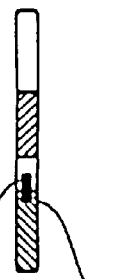
FIG. 11 shows the needle according to FIG. 8, cut along the sectional line XI—XI.
Figure 8:
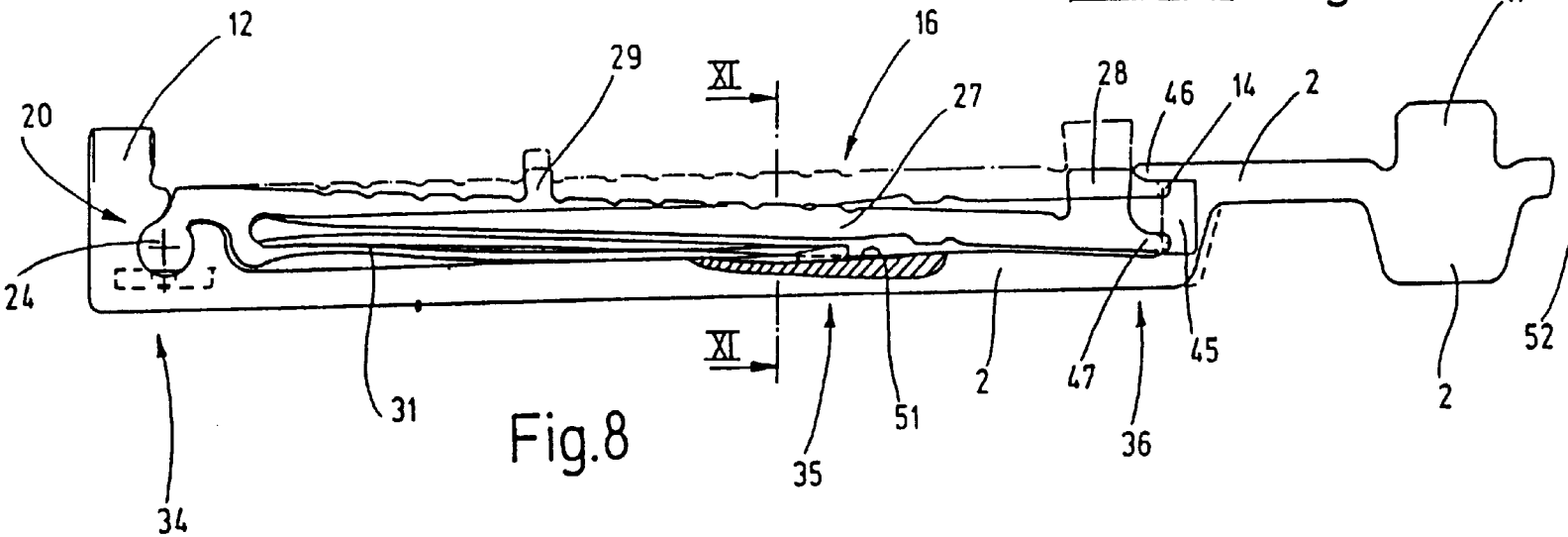
FIG. 8 illustrates an alternative embodiment of a needle having a movable selector element.

A slot (recess) 51, which is laterally limited by a respective flank, is provided on the inner edge of the back 14 of the needle body 2 facing the recess 17, namely in the region in which the free end of the leaf-spring element 31 rests against the back 14 of the needle body. A longitudinal stem (form-fit element) 52, which is formed at the free end of the leaf-spring element 31, specifically on the side of the leaf-spring element 31 facing the back 14 of the needle body 2, extends into the slot 51. The longitudinal stem 52 provides lateral guidance for the leaf-spring element 31, and, at the same time, ensures that the selector element 16 is seated such that it cannot become lost. The longitudinal stem 52 approximately corresponds in length to the diameter of the head 24. If needed, it can also be longer it therefore serves simultaneously in preventing relative rotation, so the respective one-sided contact of the individual securing elements 34, 36 sufficiently secures the selector element 16 to the needle body 2. FIG. 11 particularly illustrates the extension of the stem 52, or a correspondingly flattened end of the leaf-spring element 31, into the slot 51. The other, above-described reference characters used in FIGS. 1 through 7 are also used here.

Figure 13:
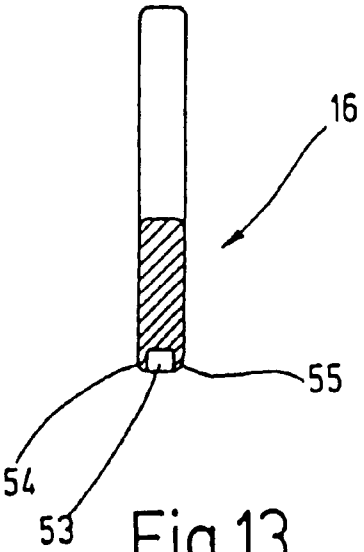
FIG. 13 shows the selector element according to FIG. 12, cut along the sectional line XIII—XIII.
Figure 12:
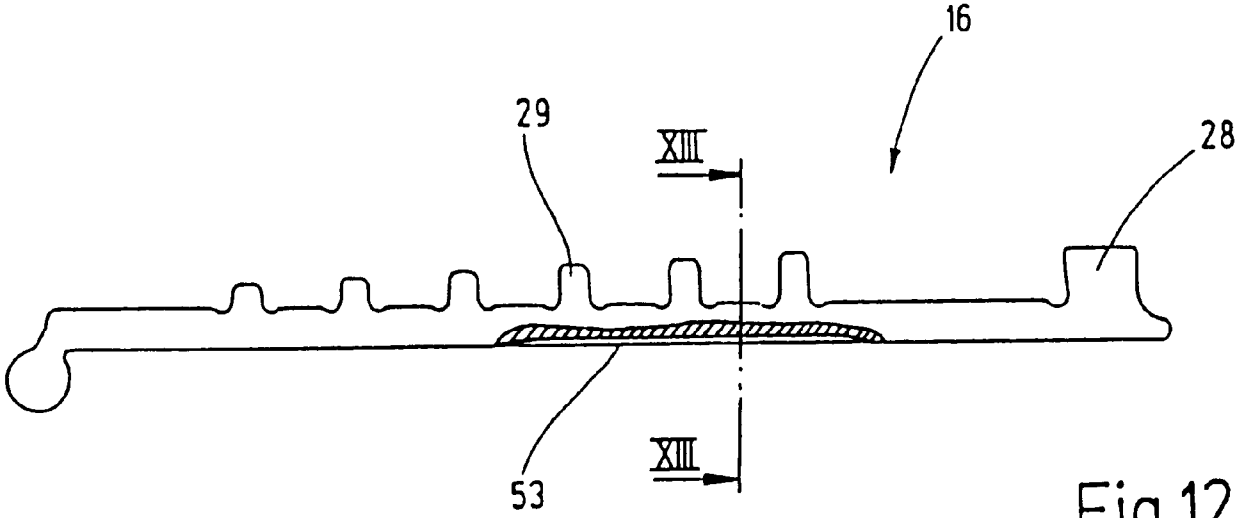
FIG. 12 illustrates a modified embodiment of a selector element, in a side view partially in section.

If necessary or desired, the leaf-spring element 31 can also be formed onto the needle body 2. In such case, a selector element 16 in accordance with FIGS. 12 and 13 should be used in this modified embodiment. The side or edge of this selector element 16 that faces the back 14 of the needle body 2 is provided with a slot 53, which is limited by two side walls 54, 55. These are apparent in FIG. 13. The slot 53 serves in receiving the tapered or laterally flattened end of the leaf-spring element 31.

In the above-described embodiments, the individual securing element 34 and the individual securing element 36 are only designed to work on one side or in one direction, with the individual securing element 35 being provided for support. As can he seen in FIG. 14, however, a possible alternative is for the individual securing element 36 to actively effect a form fit in both transverse directions 33*a*, 33*b*. In this case, the top side of the finger 47 can be provided with a groove-like depression 56 that extends in the longitudinal direction of the needle. The depression 56 has an associated rib-like protrusion 57, which is provided on the underside of the catch 46 and extends in the longitudinal direction of the needle. The protrusion 57 is embodied to fit into the depression 56.

Figure 15:
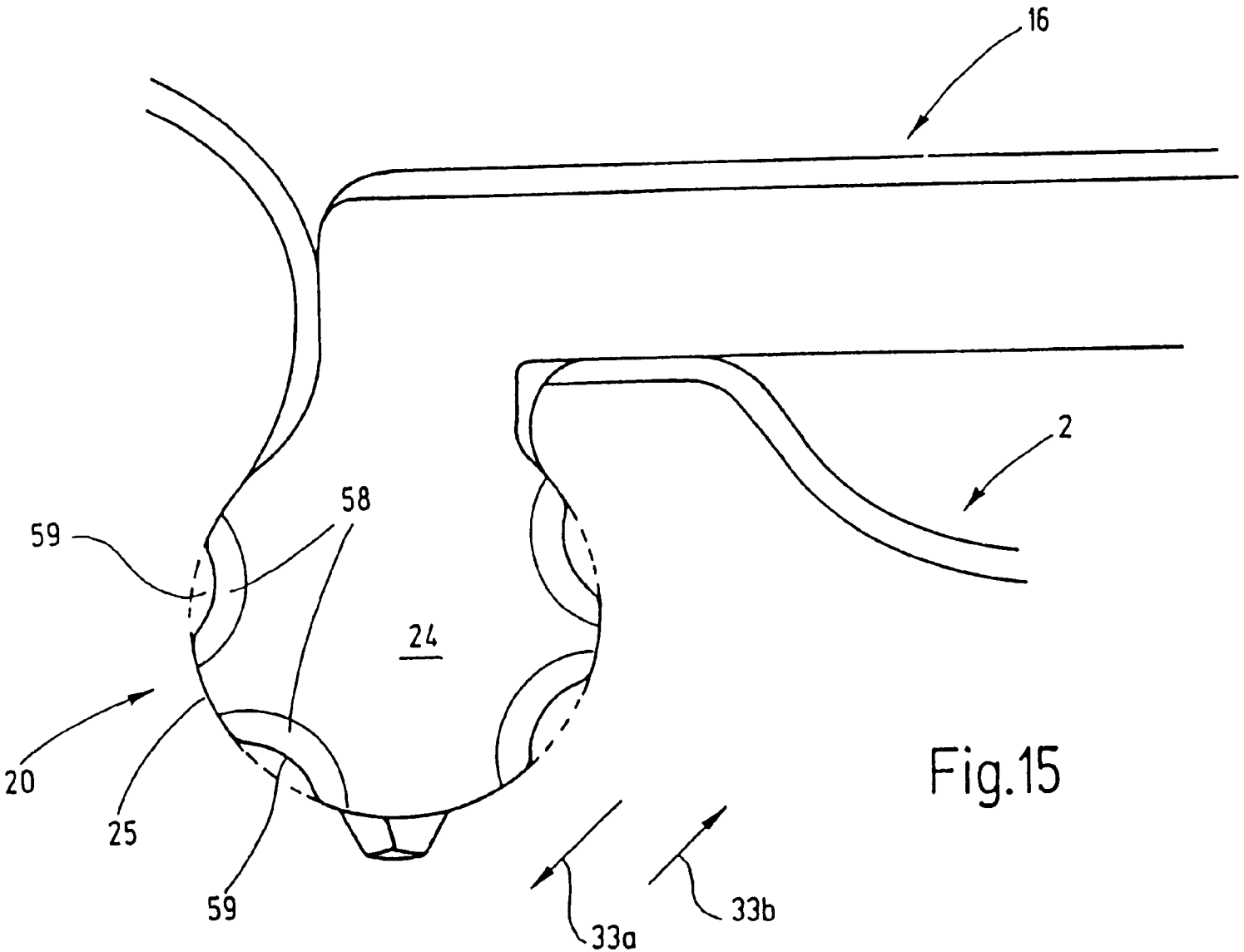
FIG. 15 illustrates a modified embodiment of the needle, with the hinge region in a cutout representation.

As can be seen in FIG. 15, the individual securing element 34 can also be designed to act in both transverse directions 33*a*, 33*b*. In this instance, at least one, but possibly more, dent-like depressions 58 can be cut into the two oppositely-located flat sides of the head 24. Catches 59 embodied at the edge of the bearing opening 25 cover the depressions.

Figure 14:
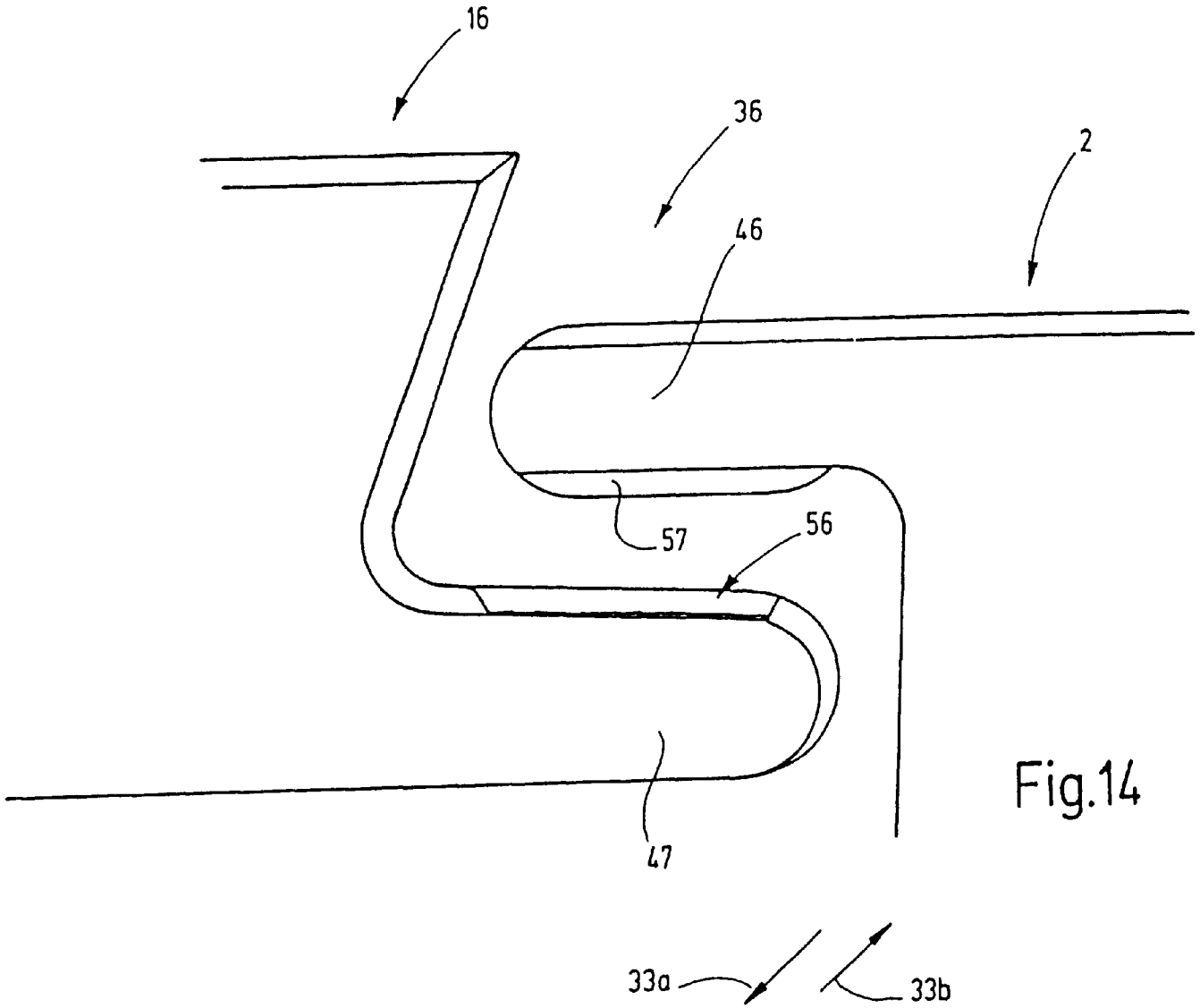
FIG. 14 illustrates a modified embodiment of a needle in accordance with the invention, with a cutout, perspective representation of the needle body and the end of the selector element.

If the two ends of the selector element 16 are secured by a form fit at both ends, as in the embodiments shown in FIGS. 14 and 15, for example, the individual securing element 35, which is otherwise formed by the leaf-spring element 31, can be omitted. It is also possible that, in some applications, an individual securing element 34, 35, 36 suffices, and secures the selector element to the needle in a form fit.

Figure 16:
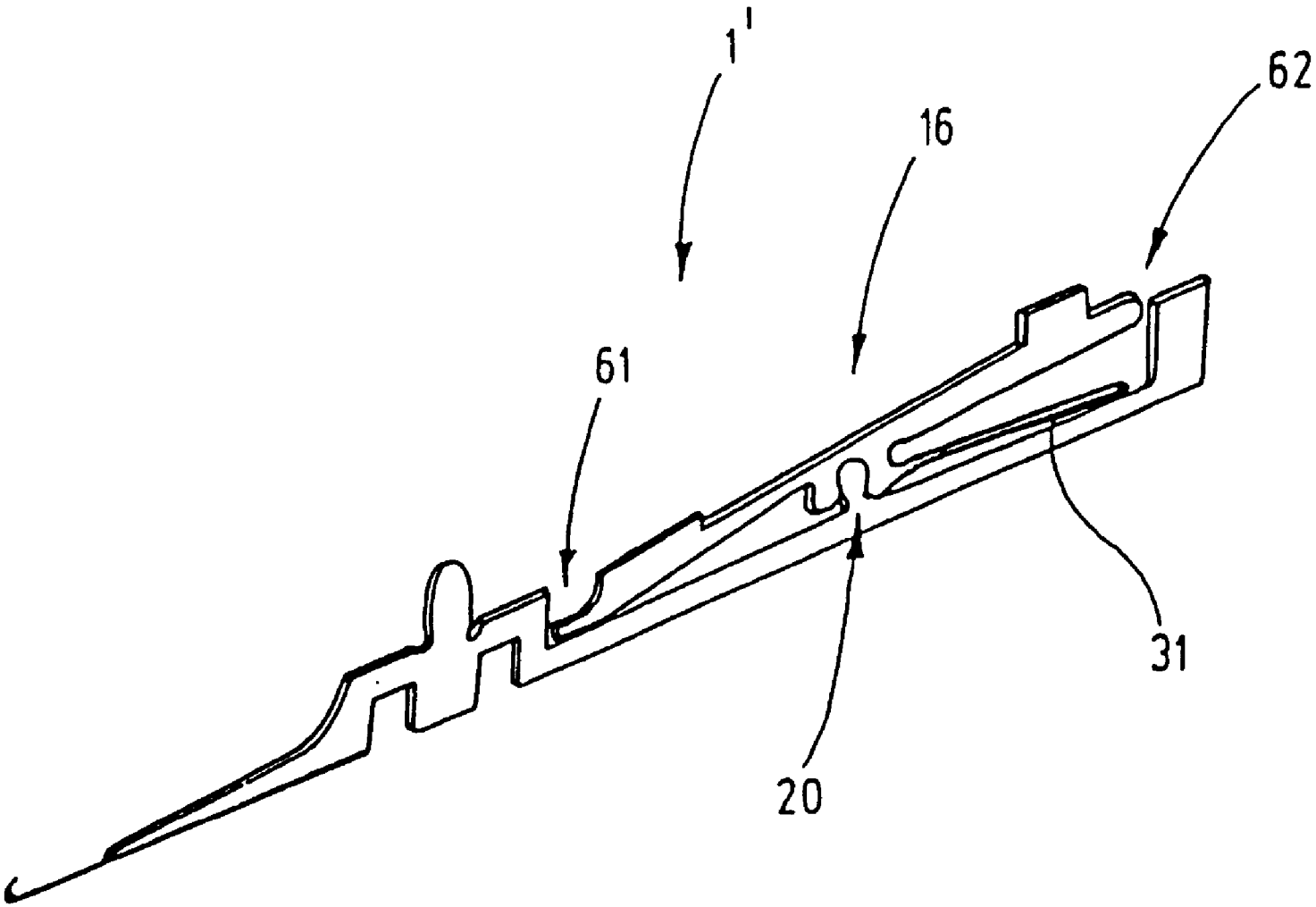
FIG. 16 illustrates a further embodiment of a needle in accordance with the invention, in a perspective representation.

FIG. 16 illustrates a modified embodiment of the needle 1 as the needle 11. It differs from the above-described needle 1 through the arrangement of the hinge 20 approximately in the center of the selector element 16. The selector element can be provided with a respective individual securing element at the hinge element 20, as well as at its leaf-spring element 31 and its two ends 61, 62, as described above. Individual securing elements 36 can be provided at the two ends 61, 62, as shown in FIG. 6 for the front end of the selector element 16.

In summary, to improve the handling of a needle 1 having a selector element 16 that is seated to pivot on the needle body 2, a fastening element 32 is additionally provided. This element 32 secures the selector element 16 to the needle body 2 in a form fit. One or more individual securing element 34, 35, 36 acting in the transverse direction 33 serves or serve as a fastening element 32. The individual securing elements (34, 35, 36) can act in one direction or in both transverse directions. They are embodied to prevent the selector element 16 from falling out of the needle body 2 in both lateral directions. For this purpose, at least one individual securing element 34, 35, 36 that acts in the transverse directions 33*a*, 33*b* is provided. It is possible to combine all of the individual securing elements 24, 35, 36.

The invention now being fully described, it will be apparent to one of ordinary skill in the art that many changes and modifications can be made thereto without departing from the spirit or scope of the invention as set forth herein.

What is claimed is:

1. A system component for knitting machines, comprising:

a base body that is provided with a section that allows it to be received in a needle groove, the section having two oppositely-located parallel flat sides;

a selector element that is designed for imparting a movement in the longitudinal direction to the base body and can engage or disengage a drive device, and that is connected, at least in the direction of movement, to the base body; and at least one securing means for securing the selector element to the base body to prevent a lateral misalignment, at least in a transverse direction oriented transversely to the direction of movement and to the two oppositely-located parallel flat sides.

2. The system component according to claim 1, wherein the selector element is connected to and seated on the base body to pivot about a pivot axis.

3. The system component according to claim 2, wherein the pivot axis extends perpendicular to the flat sides of the section of the base body.

4. The system component according to claim 2, wherein the pivot axis is oriented in the transverse direction.

5. The system component according to claim 2, wherein the selector element that is separate from the base body and is connected to the base body via a hinge whose axis is the pivot axis.

6. The system component according to claim 2, further comprising a spring element that is associated with the selector element and resiliently prestresses the selector element in a direction about the pivot axis.

7. The system component according to claim 2, further comprising a spring element associated with the system component and resiliently prestressing the selector element in a pivot direction about the pivot axis.

8. The system component according to claim 7, wherein the spring element is a leaf spring having one end connected to one of the selector element and the base body and its other end resting on an edge surface of one of the base body and the selector element.

9. The system component according to claim 7, further comprising a stop on the base body against which the selector element is resiliently prestressed.

10. The system component according to claim 1, wherein the selector element is elongated in the longitudinal direction of the system component, is seated to move in a recess formed in the base body, and is identical in thickness to the base body.

11. The system component according to claim 1, wherein the securing means includes at least one protrusion disposed on one of the base body and the selector element, and a recess that is associated with the protrusion disposed on the other of the base body and the selector element, with the protrusion extending into the associated recess, at least in an inoperative position of the selector element.

12. The system component according to claim 8, wherein the securing means includes a form-fit element that is provided on one of the spring element and said edge surface of the base body, and a recess in the other of the spring element and the base body and into which the form-fit element extends.

13. The system component according to claim 12, wherein the recess is provided on the spring element.

14. The system component according to claim 12, wherein the recess is provided on the edge surface of the base body.

15. The system component according to claim 11, wherein the recess is provided on the selector element.

16. The system component according to claim 6, wherein the spring element is integrally connected in one piece to the selector element.

17. The system component according to claim 11, wherein the selector element is mounted on the base body via a hinge element that permits relative pivotable movement, and the protrusion and the recess are provided on the hinge element.

18. The system component according to claim 11, wherein the selector element is mounted on the base body via a hinge element that permits relative pivotable movement and that is disposed at one end of the elongated selector element, and the protrusion and the recess are provided at the end of the selector element opposite the hinging element.

19. The system component according to claim 10, wherein the selector element is mounted on the base body via a hinge element that permits relative pivotable movement, and that is disposed substantially in the center of the length of the elongated selector element.

20. The system component according to claim 1, wherein the system component is a needle.

* * * * *